US005178271A

United States Patent [19]

Adams et al.

[11] Patent Number: 5,178,271

[45] Date of Patent: Jan. 12, 1993

[54] TWO CARTONS JOINED AS A SINGLE UNIT SEPARABLE INTO TWO SINGLE CARTONS

[75] Inventors: John M. Adams, Mechanicsville; Christopher N. Chance, Richmond; James A. BeBlasio, Midlothian; Donald H. Evers, Richmond; William C. Harris, Jr., Midlothian; Michael A. Kirby, Sr., Trevilians; Reginald W. Newsome; Xuan M. Pham, both of Richmond; Robert E. Talley, Chester, all of Va.

[73] Assignee: Philip Morris Incorporated, New York, N.Y.

[21] Appl. No.: 809,922

[22] Filed: Dec. 19, 1991

Related U.S. Application Data

[63] Continuation-in-part of Ser. No. 774,529, Oct. 8, 1991, Pat. No. 5,141,106.

[51] Int. Cl.[5] ..... B65D 5/00; B65D 85/10

[52] U.S. Cl. ..... 206/256; 206/273; 206/813; 229/120.011

[58] Field of Search ..... 206/813, 256, 273; 229/120.011; 53/412, 416, 419, 444, 448, 449

[56] References Cited

U.S. PATENT DOCUMENTS

| | | | |
|---|---|---|---|
| 1,673,426 | 6/1928 | Tinsley | 229/132 |
| 2,109,583 | 3/1938 | Bennett | 206/813 |
| 2,565,509 | 8/1951 | Marcin | 206/813 |
| 2,605,897 | 8/1952 | Rundle | 206/264 |
| 2,697,544 | 12/1954 | Morand | 229/120.04 |
| 2,771,234 | 11/1956 | Hultin | 229/120.08 |
| 2,871,080 | 1/1959 | Shelly | 229/120.01 |
| 2,895,601 | 7/1959 | Krukonis | 206/256 |
| 3,071,244 | 1/1963 | Doran | 206/273 |
| 3,082,929 | 3/1963 | Aquino et al. | 206/256 |
| 3,086,650 | 4/1963 | Chapman et al. | 206/273 |
| 3,113,673 | 12/1963 | Stein | 206/65 |
| 3,144,190 | 8/1964 | Holt et al. | 229/120.17 |
| 3,160,341 | 12/1964 | Cherney | 206/813 X |
| 3,163,351 | 12/1964 | Borgardt | 206/256 |
| 3,241,738 | 3/1966 | Freiman | 206/813 X |
| 3,322,323 | 5/1967 | Greene et al. | 206/813 X |
| 3,447,733 | 6/1969 | Smith et al. | 229/37 |
| 3,503,568 | 3/1970 | Galley | 242/74 |
| 3,536,246 | 10/1970 | Rosen | 206/256 |
| 3,596,758 | 8/1971 | Phillips, Jr. et al. | 206/256 |
| 3,721,335 | 3/1973 | Grant | 206/256 |
| 3,752,308 | 8/1973 | Begemann | 206/273 |
| 3,759,378 | 9/1973 | Werth | 206/429 |
| 3,809,227 | 5/1974 | Begemann | 206/264 |
| 4,424,658 | 1/1984 | Focke | 53/398 |
| 4,441,611 | 4/1984 | Sommariva | 206/431 |
| 4,485,926 | 12/1984 | Lenzmeier | 206/602 |
| 4,631,900 | 12/1986 | Mattei et al. | 53/448 |
| 4,669,611 | 6/1987 | Flaherty | 206/442 |
| 4,738,359 | 4/1988 | Phillips, Jr. | 206/256 |
| 4,928,817 | 5/1990 | Focke | 206/256 |
| 4,932,534 | 6/1990 | Focke et al. | 206/602 |

FOREIGN PATENT DOCUMENTS 358560 10/1931 United Kingdom .

*Primary Examiner*—William I. Price

*Attorney, Agent, or Firm*—Jeffrey H. Ingerman; Karen G. Horowitz

[57] ABSTRACT

A dual cigarette carton formed from two substantially identical single cigarette cartons. The two cartons are connected along their front walls, which face one another, with releasable adhesive, and along their bottom walls with a label such that the two cartons remain securely connected when in the dual carton configuration and hence can be processed for tax-stamping through standard machinery and distributed to the consumer as a dual unit. The cartons can readily be separated by the consumer for the sale of an individual carton.

12 Claims, 4 Drawing Sheets

FIG. 4
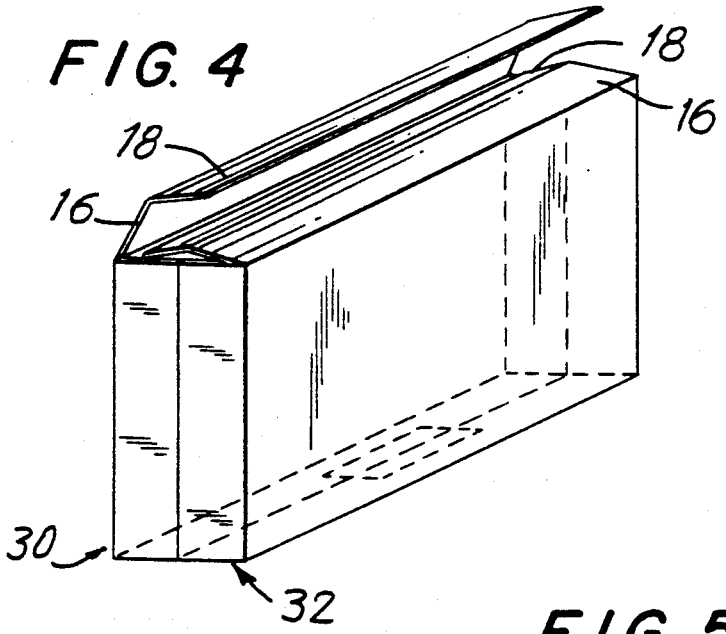
FIG. 5
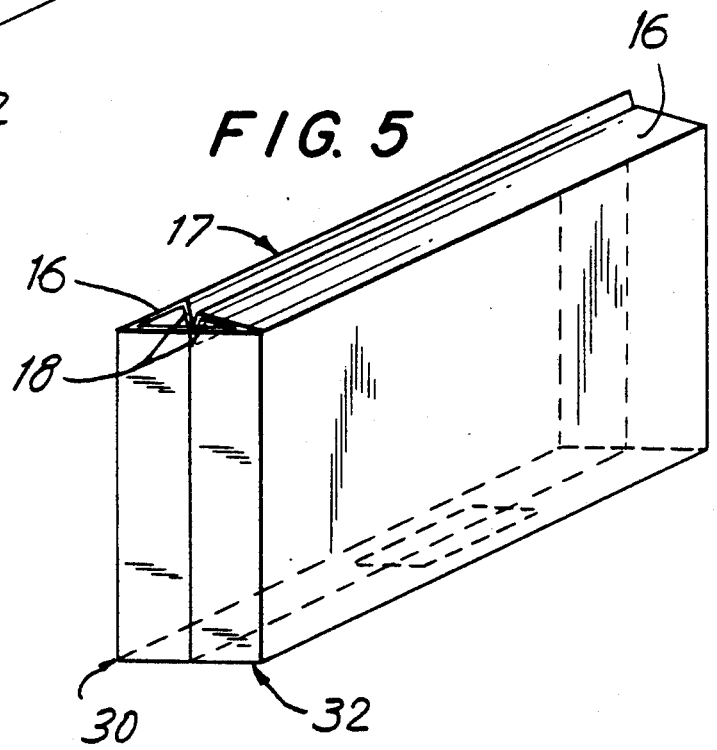
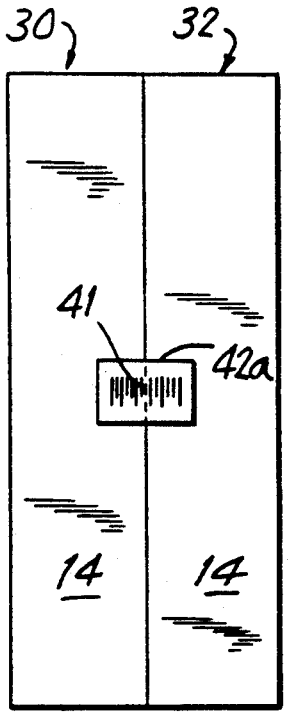
FIG. 6

TWO CARTONS JOINED AS A SINGLE UNIT SEPARABLE INTO TWO SINGLE CARTONS

This is a continuation-in-part of copending, commonly-assigned U.S. patent application Ser. No. 07/774,529, filed Oct. 8, 1991, now U.S. Pat. No. 5,141,106 which is hereby incorporated by reference in its entirety.

BACKGROUND OF THE INVENTION

This invention relates to cigarette cartons, and more particularly to the connection of two separate cigarette cartons to form a dual carton.

Cigarette packs (which usually contains twenty cigarettes) are generally rectangular in shape, having front and back long walls and two short side walls. Cigarette cartons typically contain two rows of five cigarette packs per row (each row arranged so that the front long walls of the packs are in the same plane and the back long walls are in a parallel plane spaced from the front long walls), and are generally known in the art as ten-pack cartons. Such cigarette cartons are generally filled with cigarette packs by the manufacturer, temporarily closed (e.g., by folding the top flap of the carton over the box and releasably securing the flap in the closed position), and shipped to various distributors. The distributors generally open the cartons, after they are received, to apply the tax stamp that may be required by the jurisdiction in which they operate to the ends of the individual cigarette packs inside the cartons Such procedures are commonly automated to reduce time, cost, and labor through the use of specially designed machines for applying tax stamps. Tax-stamping machines have been developed to open the cartons, apply the stamps, and finally seal the cartons for distribution. Such machines are generally commercially available, and are well known in the art. These machines have been developed for standard ten-pack cigarette cartons. A typical tax-stamping machine is model FUSON manufactured by Meyercord of 365 East North Avenue, Carol Stream, Ill. 60187.

Single row cigarette cartons which are dimensioned to contain one row of five cigarette packs (each pack usually containing twenty cigarettes, the packs arranged so that the front long walls of the packs are in the same plane and the back long walls are in a parallel plane spaced from the front long walls), i.e., five-pack cartons, are also known in the art. However, although machinery exists for manufacturing such cartons, machinery does not exist for stamping the cigarette packs contained in such cartons. Consequently, such cartons are usually put into scored, glued, and collapsed cartons to be hand-stamped (as is done currently), or would have to be secured together in pairs to be run through the existent tax-stamping equipment in which packs in double row cartons are stamped. To assure that the tax stamp is properly registered, the means for securing the cartons must be strong enough to keep the cartons together such that they are not sheared apart by the vertical rollers of the tax stamping machines which roll along the vertical walls of the cartons to transfer the cartons between the various stages of the process.

If two narrow cartons are to be secured together, the means for securement must allow for later separation of the cartons, if desired, by the retailer or consumer. For marketing purposes, once separated, the two cartons should have little or no trace of the means for securement which would disfigure the outward appearance of the cartons.

SUMMARY OF THE INVENTION

It is therefore an object of this invention to provide for the capability of manufacturing and distributing cartons narrower than those processed by existent tax-stamping machinery common to distributors, without requiring customized tax-stamping machinery or hand stamping of the packs.

It is a further object of this invention to provide a means for securing two narrow cartons together to form a dual carton such that the two cartons do not move relative to one another while being transferred throughout the tax-stamping machinery designed to process cigarette cartons having the dimensions of the dual carton.

It is still another object of this invention to provide a means for making a clean separation between the two narrow cartons if desired for sale as individual cartons instead of as a dual carton composed of two narrow cartons.

These and other objects of the invention are accomplished in accordance with the principles of the invention by providing both adhesive and carrier means bearing adhesive to securely connect two narrow cartons, such as five-pack cartons, together to have the final combined dimensions of a dual carton, such as a ten-pack carton, which may be passed through commercially available tax-stamping machinery. The adhesive is selected so that it leaves no tacky residue after separation of the joined surfaces. The carrier means is designed to allow for the separation of the two narrow cartons, if desired, for individual sale, without leaving unsightly residue which may negatively effect marketability.

BRIEF DESCRIPTION OF THE DRAWINGS

Further features of the invention, its nature, and various advantages will be more apparent from the accompanying drawings and the following detailed description of the preferred embodiments wherein like reference characters represent like elements throughout, and in which:

FIG. 4 is an isometric view of two completely formed five-pack cartons joined to form a ten-pack carton with the top flaps of each five-pack carton lapped over the tops of the two cartons;

FIG. 5 is an isometric view of two completely formed five-pack cartons joined to form a ten-pack cartons with the top flaps of each five pack carton tucked into their respective cartons;

FIG. 6 is a bottom plan view of two five-pack cartons connected, in accordance with this invention, with carrier means bearing indicia for price coding;

DETAILED DESCRIPTION OF THE INVENTION

Figure 1:
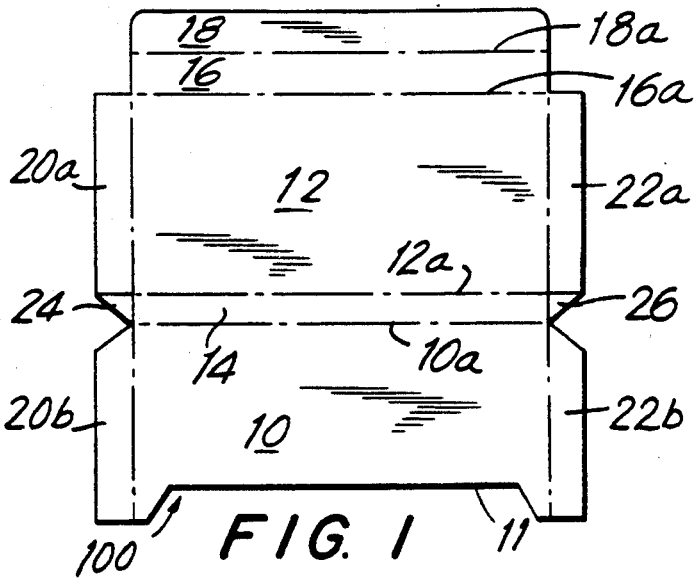
FIG. 1 is a plan view of an illustrative carton blank for a five-pack carton in accordance with this invention.

As shown in FIG. 1, blank 100, used for forming a carton adapted to hold one row of five cigarette packs, i.e., a five-pack, has a plurality of fold lines represented by broken lines. Blank 100 is preferably formed from a substantially rigid material such as paperboard. Each relatively large panel 10 and 12 of blank 100 is substantially five times the width of a long wall of a cigarette pack to be enclosed therein. As used herein, a standard cigarette pack is defined as any pack commonly used for holding a predetermined number of cigarettes, and generally having front and back long walls connected by two short side walls (each pack usually containing twenty cigarettes). Panel 10 may optionally include cut out portion 11 which causes panel 10 to be slightly shorter than panel 12 to facilitate removal of cigarette packs which will be contained in the completed carton. When blank 100 is folded along respective fold lines 10*a* and 12*a*, panel 10 will become the front wall of the carton and panel 12 will become the rear wall of the carton. Joining panels 10 and 12 is a bottom panel 14, which will form the bottom wall of the carton when the blank is folded into a carton. Panel 16, having substantially the same dimensions as bottom panel 14, extends from rear panel 12. After walls 10 and 12 are assembled, panel 16 is folded along fold line 16*a* over the top of the carton to extend between walls 10 and 12 of the carton. Extension panel 18 joins panel 16 along a fold line 18*a*. Additional fold lines, similar to fold lines 10*a*, 12*a*, 16*a* and 18*a*, are located on blank 100, but are not individually labeled.

Panels 16 and 18 together form a top and tuck-in flap 17. When the carton is formed and is ready for consumer purchase, extension panel 18 preferably lies substantially parallel to front wall 10, preferably inside the carton, and panel 16 is folded over the top of the carton towards front wall 10. Side panels 20*a* and 20*b* are folded one over the other to form a side wall 20 of the carton. Side panels 22*a* and 22*b* are folded in a similar fashion to form side wall 22. The "a" panel is preferably folded over the "b" panel. Tabs 24 and 26 are preferably folded perpendicular to panel 14 before the side panels are folded and will eventually lie substantially parallel to side walls 20 and 22, respectively. The distance between panels 10 and 12 of the completed carton is substantially the same as the distance between the two front and back long walls of a cigarette pack to be enclosed therein.

Blank 100 has an inner surface and an outer surface. When blank 100 is formed into a carton, the inner surface of the blank is that which faces the cigarette packs placed inside the completed carton, and the outer surface of the blank is that which faces outward and is readily visible. The outer surface of the blank generally bears printed information such as the brand name and quantity of the contents of the carton.

Figure 2:
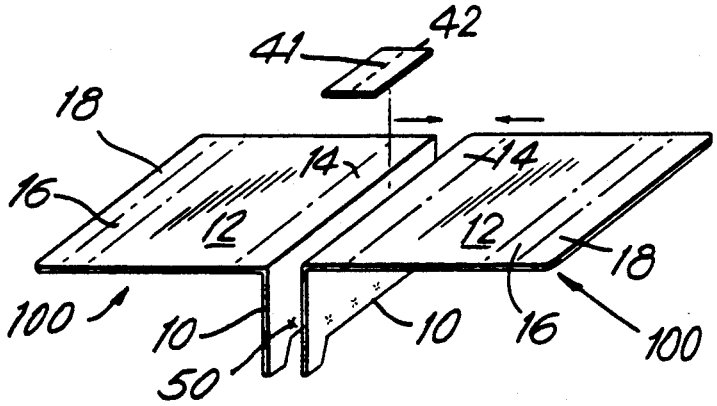
FIG. 2 is an exploded isometric view of two five-pack carton blanks positioned adjacent one another in preparation for connection to each other to form a ten-pack carton in accordance with this invention.

FIG. 2 reveals two partially folded blanks 100, 100 for five-pack cartons positioned adjacent one another in preparation for connection to each other. It will be appreciated that panels 20*a*, 20*b*, 22*a*, 22*b*, and tabs 24 and 26 have been omitted from the drawing only for the sake of clarity, and are not intended to be excluded from the invention as depicted.

The blanks are joined along the upper edge of the outer surfaces of their interior front walls 10 with adhesive 50. Adhesive 50 is preferably a tack/no-tack adhesive such as a releasable, pressure-sensitive adhesive. Releasable, pressure-sensitive adhesive is herein defined as any adhesive known in the art which, preferably, is clear, has no taste or odor, and does not cause fiber pull or leave a tacky residue once the surfaces joined by the adhesive are separated (e.g., adhesive which provides a strong bond between surfaces, but once the surfaces are pulled apart, the bonds of the adhesive are broken and the adhesive is no longer tacky).

The blanks are further joined along the outer surfaces of their bottom walls 14 with a carrier means bearing adhesive, such as a sticker 42. The adhesive on sticker 42 may either be a releasable adhesive with similar properties as glue 50, or a permanent adhesive such as any permanent adhesive known in the art. Sticker 42 may also include a frangible means such as perforated line 41 to facilitate a clean and simple separation of the two cartons. A weakened line such as line 41 is particularly helpful if permanent adhesive is used on sticker 42.

Figure 3:
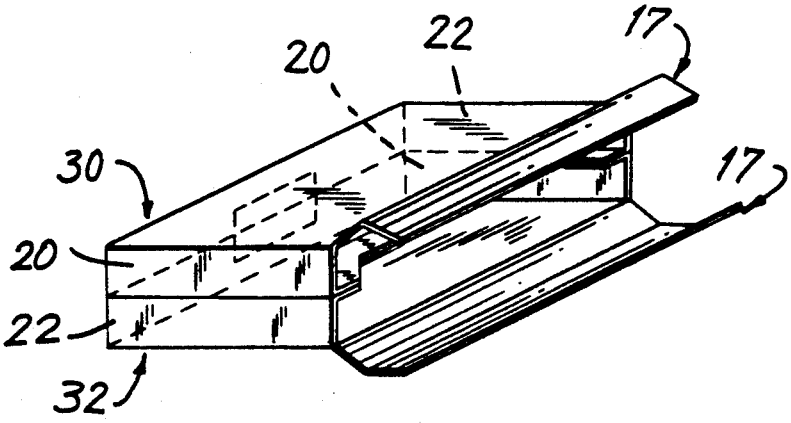
FIG. 3 is an isometric view of two completely formed five-pack cartons joined to form a ten-pack carton, before cigarette packs are inserted into the cartons.

The completed, connected cartons 30, 32 are shown in FIG. 3, with their flaps 17 open. The cartons now are ready for the insertion of two rows of five cigarette packs per row. After the cigarette packs are inserted, flaps 17 may be lapped one over the other, such as shown in FIG. 4, in preparation to be shipped to a distributor and later opened for tax-stamping. After tax-stamping, flaps 17 may be lapped, once again or, alternatively, may be tucked into their respective cartons, instead, as shown in FIG. 5, for distribution to individual wholesalers or retailers. In the position shown in FIG. 5, panels 16 extend across the tops of their respective cartons, 30, 32, and panels 18 lie substantially parallel to their respective front walls 10.

Because the "a" panels of blank 100 are preferably folded over the "b" panels (panels 20*a*, 22*a*, 20*b*, and 22*b* shown in FIG. 1), the free edge of each of the "a" panels of the side walls faces inwardly, i.e., the free edges lie adjacent interior walls 11, when cartons 30, 32 are joined. In this configuration, the free edges of the "a" panels are not readily accessible and thus are relatively safe from being accidentally lifted from their place adjacent the "b" panels.

Sticker 42 may optionally bear Universal Product Code (U.P.C.) indicia or other pricing indicia, (e.g., pricing bar code), such as seen on sticker 42*a*, in FIG. 6. The indicia are positioned such that they are rendered unreadable by automatic scanning equipment upon separating the cartons, such as described in copending, commonly assigned patent application Ser. No. 07/792,617, which is hereby incorporated by reference in its entirety. Sticker 42*a* is placed along the bottom walls 14 of cartons 30, 32. Optional frangible means such as perforated line 41 may be included on sticker 42*a*, positioned substantially parallel to the adjacent edges of the walls across which sticker 42*a* is placed. In the embodiment having pricing indicia, the lines of the pricing bar code are preferably positioned substantially parallel to frangible means 41. Similar pricing indicia may be located on the outer surfaces of front walls 10 of the cartons. Such indicia either may be printed directly on the walls or may be printed on labels or stickers positioned on the walls. The readily visible indicia printed on sticker 42*a* are preferably coded for sale of the combined ten-pack carton and are rendered unreadable by automatic scanning equipment by automatic scanning equipment upon tearing the sticker 42 to separate the two five-pack cartons. The not readily visible indicia on front walls 10 are preferably coded for sale of the individual five-pack cartons, and can be scanned only after separating the dual carton into individual cartons.

Figure 7:
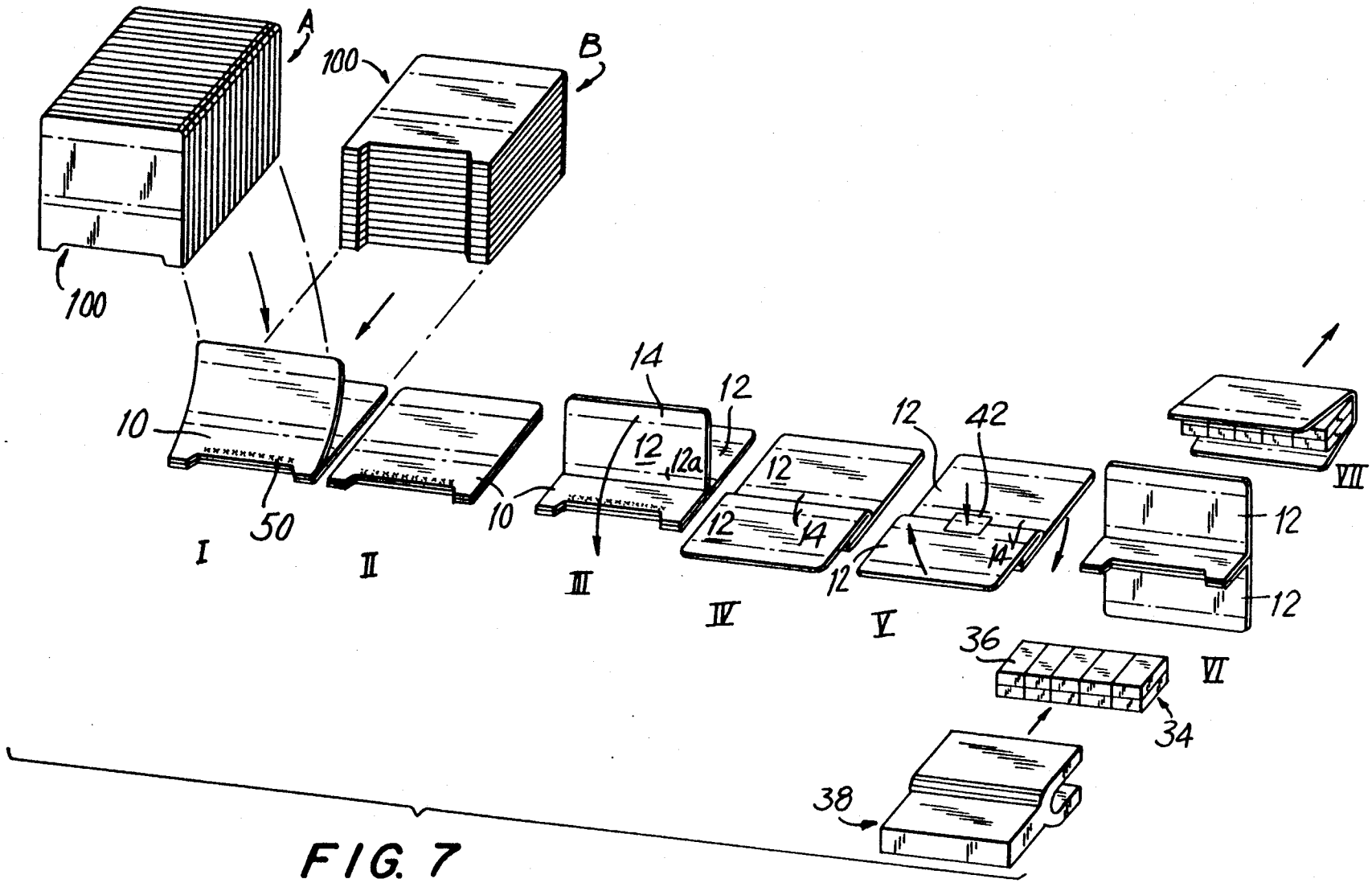
FIG. 7 is a schematic representation of the steps involved in forming a ten-pack carton from two five-pack carton blanks in accordance with this invention.
Figure 8:
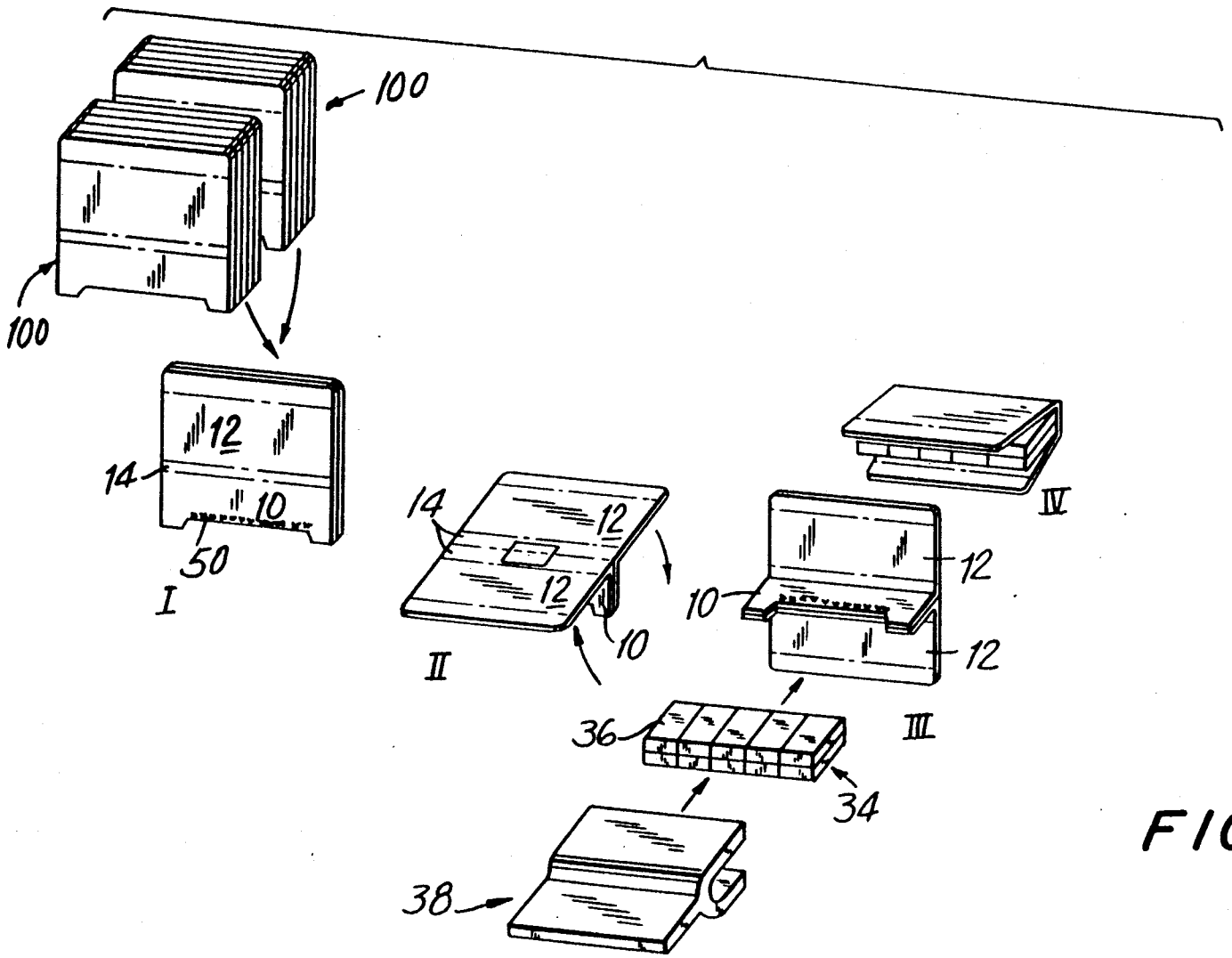
FIG. 8 is schematic representation of the steps involved in forming a ten-pack carton from two five-pack carton blanks in accordance with this invention, the blanks oriented differently than in the representation of FIG. 7.

The preferred steps taken in constructing the dual carton formed from cartons 30, 32 are illustrated but not limited to those shown in FIG. 7 or 8. In the method shown in FIG. 7, two stacks A, B of blanks 100 are positioned substantially perpendicular to one another. A single blank 100 from each stack is drawn from the stack, in step I, and connected with adhesive 50 along the outer surfaces of the front panels 10 of the two blanks 100. Each blank preferably bears printed matter on its outer surface, and may optionally bear pricing indicia, such as U.P.C. indicia, on the outer surface of panel 10. The blanks are positioned one on top of the other, in step II, so that the borders of the two blanks are aligned with each other. In step III, rear wall 12 of the upper blank is folded along fold line 10*a* to be perpendicular to the lower blank. This step is completed in step IV, so that panels 12 lie in the same plane, with bottom walls 14 lying between panels 12 in the same plane as panels 12. Both panels 10 of the two blanks are now perpendicular to the remaining panels of the blanks. Sticker 42, which optionally bears pricing indicia such as U.P.C. indicia, is placed across the outer surfaces of panels 14 in step V. The two blanks are now rotated 90° and, as seen in step VI, cigarette bundle 34, composed of two rows of five cigarette packs 36 per row, are positioned by cigarette pack pushing equipment 38 into the nearly completed dual carton. Once the cigarette packs are in place, the remaining panels of the blanks may be folded to complete the two cartons, as seen in step VII It will be appreciated that panels 20*a*, 20*b*, 22*a*, and 22*b*, and tabs 24 and 26 have been omitted from the drawings only for the sake of clarity, and are not intended to be excluded from the blanks used in the steps depicted.

The orientation of the stacks A, B of blanks 100, which are substantially identical to those shown in FIG. 7, may be modified as seen in FIG. 8, such that, in step I, the blanks are positioned parallel to one another, oriented as stack A in FIG. 7. The blanks are positioned against one another, in step I, as in FIG. 7 and similarly connected with adhesive 50. In step II panels 12 and 14 are folded perpendicular to panels 10, and sticker 42, which optionally bears pricing indicia such as U.P.C. indicia, is positioned across the outer surfaces of panels 14. The blanks are rotated such that step III and step IV are substantially identical to step VI and step VII, respectively, of FIG. 7.

Although sticker 42 is shown placed across bottom walls 14, sticker 42, or additional stickers similar to sticker 42, may be placed across side walls 20 or 22 or both. Additionally, a transparent band of material, such as common in the art, may be wrapped around the cartons to further secure them together.

It will be appreciated that sticker 42 may or may not bear U.P.C. or other pricing indicia (which preferably bear coding for sale of the dual carton). If such indicia are included, the sticker bearing such indicia may be used in combination with any or all of the disclosed stickers. Such indicia are situated such that the coding for ten-pack sale is rendered unreadable by automatic scanning equipment upon separation of cartons 30, 32. Furthermore, such indicia may be located on a sticker placed across any pair of adjacent coplanar walls as desired. Preferably only one sticker bearing pricing indicia is used.

Although flaps 17, designed to be tucked into cartons 30, 32, are shown, it will be appreciated that any appropriate flap may be used, such as a flap with portion 16 without extension 18, intended to be lapped over the top of the carton, but not tucked partially inside the carton.

Although extension panel 18 is described as tucked inside the carton, extension panel 18 may alternatively be secured to the outside of the carton.

Although cartons 30, 32 are described as each dimensioned to hold one row of five cigarette packs, they may be lengthened or shortened to hold more or fewer than five packs. Furthermore, it will be appreciated that these concepts may be applied to the connection of cartons of other configurations for which distributors commonly have tax-stamping machinery.

It will be appreciated that references to cigarette cartons and cigarette packs are not limited to only rectangular cartons and packs, but are intended to include all configurations which are available to consumers. Cigarette cartons include cartons with windows, cartons with rounded edges, and other configurations which are designed to be passed through tax-stamping equipment. Cigarette packs include such packs as oval packs, packs with rounded edges, and other non-rectangular shapes.

It will be appreciated that references to tax-stamping machinery are intended to include any existing equipment which is readily available to distributors, and modified versions.

It will be appreciated that panels 10 may have a cutout portion 11 of any desired depth, including no depth at all, i.e., without any cutout portion.

Although adhesive 50 is shown along the top edge of panels 10, adhesive 50 may be positioned along other portions of panels 10 such that adhesive 50 is not readily visible when cartons 30, 32 are connected to each other.

It will be understood that the foregoing is merely illustrative of the principles of the invention, and that various modifications can be made by those skilled in the art without departing from the scope and spirit of the invention. The present embodiments are described for the purpose of illustration rather than limitation, and the present invention is limited only by the claims which follow.

What is claimed is:

1. A dual cigarette carton for packaging a first number of cigarette packs and of dimensions compatible with commercially available tax-stamping machinery used in the automated processing of cigarette cartons, each said cigarette pack having a pair of opposed long walls and a pair of opposed short walls, said dual cigarette carton comprising:

first and second cartons each having four substantially vertical walls, an exterior top wall, and an exterior bottom wall; said four substantially vertical walls including an interior front wall, an exterior rear wall substantially parallel and spaced from said interior front wall, and first and second exterior side walls connecting juxtaposed vertical edges of said interior front wall and said exterior rear wall; wherein said exterior rear wall has an extension along the top edge thereof, said extension being folded substantially perpendicular to said exterior rear wall and extending towards said interior front wall, thereby forming said exterior top wall;

the widths of said interior front wall and said exterior rear wall are at least as wide as a second number of times the width of the long wall of said cigarette pack;

the widths of said exterior side walls are at least as wide as a third number of times the width of the short wall of said cigarette pack;

a fourth number of cigarette packs, equal to the product of said second number of times the width of the long wall of said cigarette pack and said third number of times the width of the short wall of said cigarette pack, can be positioned inside said first carton with said short walls parallel said side walls; and said first and second cartons are positioned adjacent one another with said interior front wall of said first carton coextensive with said interior front wall of said second carton such that the borders of said interior front walls are aligned; said dual cigarette carton further comprising:

releasable, pressure-sensitive adhesive applied between said interior front wall of said first carton and said interior front wall of said second carton to securely yet releasably connect said cartons in position adjacent one another such that the borders of said interior front walls are aligned; and at least one substantially flat carrier means having a first side and a second side, and an adhesive borne on one side of said carrier means, said carrier means bearing said adhesive being positioned across at least one pair of adjacent, coplanar, exterior walls of said first and second cartons with said adhesive in operative contact with said last mentioned exterior walls to securely yet releasably connect said cartons in position adjacent one another such that the borders of said interior front walls are aligned; wherein:

said dual cigarette carton is dimensioned to contain twice the fourth number of cigarette packs, which is equal to said first number of cigarette packs.

2. The dual cigarette carton of claim 1 wherein said releasable, pressure-sensitive adhesive is an adhesive that does not leave a tacky residue upon separation of said first and second cartons.

3. The dual cigarette carton of claim 1 wherein said carrier means has a line of weakness positioned above and substantially parallel to the adjacent edges of the exterior walls across which said carrier means is positioned.

4. The dual cigarette carton of claim 3 wherein said line of weakness is constituted by a line of perforations.

5. The dual cigarette carton of claim 1 wherein said interior front walls of said first and second cartons each have a cut out portion along the top edge thereof to facilitate removal of cigarette packs contained in the cartons.

6. The dual cigarette carton of claim 1 wherein said carrier means bears indicia encoded for automatic pricing of the dual cigarette carton, and each said interior front wall of said cartons bears indicia encoded for automatic pricing of an individual carton.

7. The dual cigarette carton of claim 6 wherein said indicia borne on said carrier means are bar code lines printed substantially parallel to the adjacent edges of the walls across which said carrier means is positioned, such that said indicia are rendered unreadable by automatic equipment when said carrier means is torn upon separating said cartons for sale of the individual cartons.

8. The dual cigarette carton of claim 7 wherein said carrier means has a line of weakness positioned above and substantially parallel to the adjacent edges of the walls across which the carrier means is positioned.

9. The dual cigarette carton of claim 8 wherein said line of weakness is constituted by a line of perforations.

10. The dual cigarette carton of claim 1 wherein said at least one pair of adjacent, coplanar, exterior walls are said bottom walls of said first and second cartons.

11. The dual cigarette carton of claim 1 wherein said second number of times the width of the long wall of said cigarette pack is five times.

12. The dual cigarette carton of claim 1 wherein said second number of times the width of the short wall of said cigarette pack is one.

* * * * *